United States Patent [19]

Hanke

[11] 4,179,960

[45] Dec. 25, 1979

[54] FILM SPLICER

[75] Inventor: Rudolf Hanke, Monheim, Fed. Rep. of Germany

[73] Assignee: Hama Hamaphot K.G. Hanke & Thomas, Monheim, Fed. Rep. of Germany

[21] Appl. No.: 929,300

[22] Filed: Jul. 31, 1978

[30] Foreign Application Priority Data

Nov. 16, 1977 [DE] Fed. Rep. of Germany ..... 2751240

[51] Int. Cl.[2] ..... G03D 15/04; B26D 7/14

[52] U.S. Cl. ..... 83/175; 83/18; 83/607; 83/926 J; 156/502

[58] Field of Search ..... 83/18, 175, 607, 926 R, 83/926 J, 78; 156/502, 505, 506, 510

[56] References Cited

U.S. PATENT DOCUMENTS

| | | | |
|---|---|---|---|
| 2,923,195 | 2/1960 | Reibel et al. | 83/607 |
| 3,709,079 | 1/1973 | Wüker | 83/607 |
| 3,797,345 | 3/1974 | Allen | 83/175 |

FOREIGN PATENT DOCUMENTS

| | | | |
|---|---|---|---|
| 2637012 | 2/1978 | Fed. Rep. of Germany | 83/926 J |

*Primary Examiner*—Donald R. Schran
*Attorney, Agent, or Firm*—Ross, Ross & Flavin

[57] ABSTRACT

A film splicer has a base, a lid hinged thereto and carrying a blade, and a film support plate, which plate has two portions carrying pegs for engaging in the sprocket-holes end portions of two lengths of film to be spliced and holding them in desired positions. The said two portions of the plate are separated by a slot and the lid carries a plunger, which as the lid is closed, engages the slot to spread the portions before the cutting knife trims the ends of the lengths of film. After the cutting the two portions move back towards each other, thus compensating for the usual gap which is left between the two film length ends due to the passage of the blade.

2 Claims, 4 Drawing Figures

FILM SPLICER

FIELD OF THE INVENTION

This invention relates to film splicers. When film splicers are used to connect the ends of two lengths of film by means of an adhesive tape, a fine gap arises at the joint of the two film ends. This fine gap makes itself disturbingly noticeable on the film as a flash of light. It has been shown that this gap is mainly caused by the blade which is used to trim the two ends of the lengths of film. Because of the cutting, the ends are slightly pushed apart and do not spring back to such an extent that they are contiguous.

OBJECT OF THE INVENTION

An object of the invention is to provide a device on a film splicer having a base and a lid, hinged thereto and carrying the cutting knife, as well as a film support plate, which device causes the film cutting gap to disappear, in other words, compensates for the same. In accordance with the invention, there is provided a device for compensating for the film cutting gap on film splicers having a base and a lid, hinged thereon and carrying a cutting blade, and a film support plate, wherein said film support plate has, adjacent the joint of the to-be spliced film ends at least one slot and there is mounted on the lid a plunger which upon closure of the lid enters the slot and widens it approximately by the width of the blade the film support plate having a resilience such that it returns, after removal of said plunger from the slot upon the opening of the lid into its initial position, the cutting blade becoming effective only after widening of said slot.

Advantageously, the film support plate consists of a material having such an inherent resilience that when the plunger leaves the slot, the plate cancels the preceding deflection caused by the plunger.

It has proved to be particularly favourable if the slot edges widen conically towards the lid and the plunger has a complementary taper.

By means of the device in accordance with the invention, the cut ends are, after cutting, caused to approach one another by an amount which corresponds to the gap which arises upon the cutting of the ends. The device thus compensates for the gap which has often heretofore been formed upon cutting of the ends.

BRIEF DESCRIPTION OF THE DRAWINGS

The invention is explained hereinunder with reference to the drawings, in which.

Figure 1:
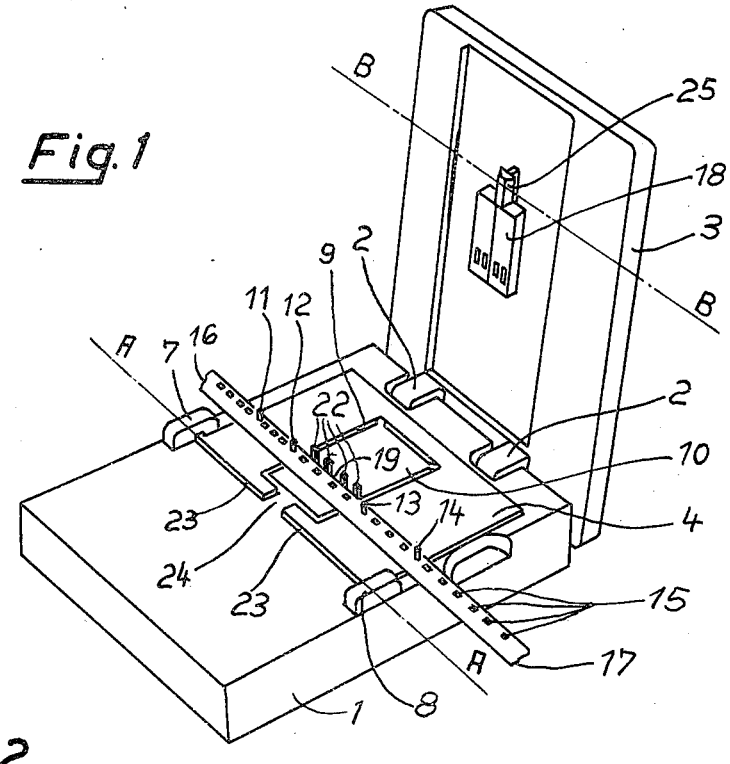
FIG. 1 shows a film splicer having the device of the present invention.
Figure 2:
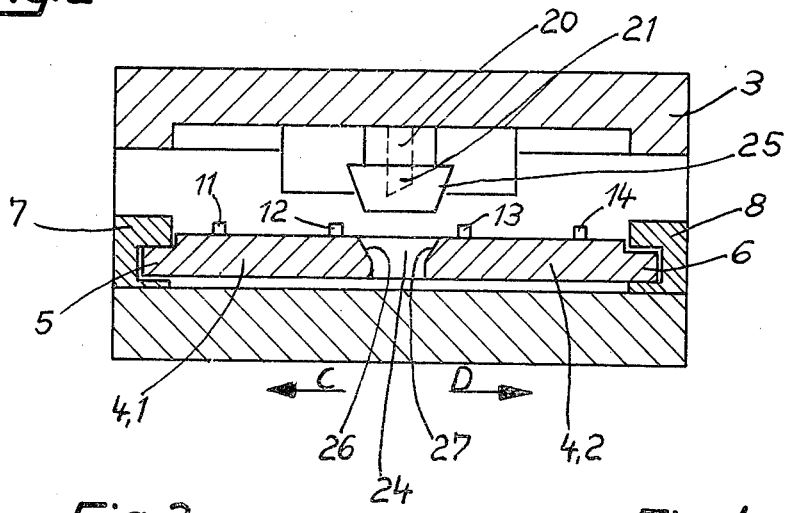
FIG. 2 is a section taken along the line A—A for the lower part and along the line B—B for the lid.

The film splicer conforming to the present invention has a rectangular base 1 and a likewise rectangular lid 3 which is mounted by hinges 2. Mounted for swinging movement by means of pins 5 and 6 and bearing blocks 7 and 8 on the base 1 is a film support plate 4 having plane-parallel sides.

Provided in the film support plate 4 is a rectangular window 9 into which there extends, in the depicted position, an adjusting prominence 10 of the base 1.

Mounted on the film support plate 4, along a line which extends transversely to the longitudinal extent of the film splicer, are upwardly-protruding pegs 11, 12, 13 and 14 which extend into holes of the perforation 15 of two films ends 16 and 17 which are to be connected together.

Additionally, a film pressing plate 18 made of resiliently elastic material, for example foam rubber, is mounted in such a way on the lid 3 that, when the lid 3 is closed, it comes flat into abutment onto the film ends 16 and 17 at the cutting point 19. In this respect, the blade 20 (which has previously been masked) will protrude with its cutting edge 21 beyond the film pressing plate 18 and will cut the film ends 16, 17 at the cutting point 19.

Mounted parallel to the line on which the teeth 11 to 14 are arranged, on the prominence 10, are upwardly-protruding tines 22 which serve for co-operation with a film bonding element or splicing tape which is not shown.

The film support plate 4 has, in the region of its swivel axis, a slot 24 which extends from the window 9 as far as the outer edge 23. A plunger 25 on the lid 3 can mate with this slot 24. The plunger 25 tapers in wedge-shaped manner towards the free end. The edges 26, 27 of the portions 4,1 and 4,2 of the film support plate 4 are likewise and complementarily tapered in such a way that the slot 24 widens upwardly in wedge-shaped manner. The dimensions are so selected that, when the lid 3 is closed, the plunger 25 enters the slot 24 and in so doing spreads the portions 4,1 and 4,2 of the film support plate 4 in the direction of the arrows C and D in such a way that the slot becomes wider approximately by the thickness of the cutting edge 21 or of the blade 20. Because the film support plate 4 is of a material having inherent resilience, for example steel, the portions 4,1 and 4,2 return into their initial position as soon as the lid 3 is opened and the plunger 25 is drawn out of the slot 24.

Figure 3:
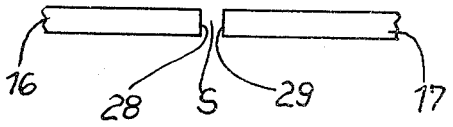
FIG. 3 shows two cut film ends having a gap between them.
Figure 4:
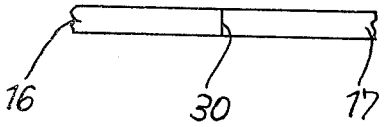
FIG. 4 shows the cut film ends after opening of the lid and withdrawal of the plunger from the slot.

When the lid 3 is closed, the plunger 25 enters the slot 24 first and widens it. Upon further closure of the lid 3, the film pressure plate 18 is compressed and the cutting edge 21 encounters the film ends and severs them at 19. Upon this severing, there can arise, between the points of separation of the film ends 16, 17, a gap S whose width corresponds to the width of the cutting edge 21 or of the blade 20. As soon as the lid 3 is opened and the plunger 25 is drawn out of the slot 24, the portions 4,1 and 4,2 return, as a result of the inherent resilience of the film support plate 4, into their initial positions. The slot 24 again assumes its original width. The spreading has been cancelled. Upon their return into the initial position, the portions 4,1 and 4,2 entrain, via the teeth 11, 12 or 13, 14, the film ends portions 16 and 17. Consequently, the separating edges 28, 29 of the film ends come to lie close together (FIG. 4) and an uninterrupted joint 30 arises at the transitional point of the film ends 16, 17. The gap S (FIG. 3), which had arisen upon the cutting between the film ends 16, 17, has in this way been made to disappear. If now, making use of the tines 22, an adhesive splicing tape is used to connect the film ends, a film joint can be achieved which is completely free from any gap at the joint.

I claim:

1. In a film splicer including a base and a lid hingedly connected to the base for movement between lid-opened and lid-closed positions relative to the base and a cutting blade depending from the lid for trimming the adjacent ends of the to-be-spliced film lengths as the lid is brought into lid-closed position, the improvement in the form of a mechanism for compensating for the gap resultant from the passage of the cutting blade through the film lengths following severance comprising:

a slotted support plate of resilient material for upwardly supporting the adjacent ends of the to-be-spliced film lengths, aligning means projecting from the support plate for accommodating sprocket holes of the to-be-spliced film lengths and holding the film lengths relative to the support plate, a plunger having a width greater than the normal width of the slot of the support plate and depending from the lid for passage into the slot in a slot-widening stroke as the lid is moved into lid-closed position and the cutting blade is concomitantly moved through the film lengths and into the widening slot, the support plate being returnable to initial position with concomitant movements of the film lengths on opposite sides of the slot toward each other following withdrawal of the plunger and cutting blade from the slot as the lid is retracted into lid-opened position.

2. A device as set forth in claim 1, wherein edges of the slot taper towards the lid and the plunger has a complementary taper.

* * * * *